US010037846B2

(12) United States Patent
Akimoto

(10) Patent No.: US 10,037,846 B2
(45) Date of Patent: Jul. 31, 2018

(54) IGNITION COIL FOR INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 50 days.

(21) Appl. No.: 15/210,205

(22) Filed: Jul. 14, 2016

(65) Prior Publication Data

US 2017/0018352 A1 Jan. 19, 2017

(30) Foreign Application Priority Data

Jul. 16, 2015 (JP) ..... 2015-141852

(51) Int. Cl.

| | |
|---|---|
| ***H01F 38/12*** | (2006.01) |
| ***F02P 3/05*** | (2006.01) |
| ***H01F 27/02*** | (2006.01) |
| *H01F 27/40* | (2006.01) |

(52) U.S. Cl.

CPC ..... *H01F 38/12* (2013.01); *F02P 3/05* (2013.01); *H01F 27/022* (2013.01); *H01F 27/40* (2013.01)

(58) Field of Classification Search

CPC ..... H01F 38/12; H01F 27/40
USPC ..... 123/633, 634
See application file for complete search history.

(56) References Cited

U.S. PATENT DOCUMENTS

| | | | | |
|---|---|---|---|---|
| 7,036,495 | B1 * | 5/2006 | Shimizu | H01T 13/05 123/260 |
| 2009/0033451 | A1 * | 2/2009 | Akimoto | H01F 5/04 336/96 |
| 2010/0253455 | A1 * | 10/2010 | Wolf | H01F 38/12 336/83 |
| 2012/0222660 | A1 * | 9/2012 | Idogawa | F02P 3/02 123/634 |

FOREIGN PATENT DOCUMENTS

| | | | |
|---|---|---|---|
| JP | 2011-100758 | 5/2011 | |
| WO | WO 2017090252 A1 * | 6/2017 | F02P 15/00 |

* cited by examiner

*Primary Examiner* — Hieu T Vo
*Assistant Examiner* — Arnold Castro
(74) *Attorney, Agent, or Firm* — Nixon & Vanderhye P.C.

(57) ABSTRACT

An ignition coil for an internal combustion engine includes an annular elastic seal which is tightly attached to a high-voltage tower and a plug installed in the high-voltage tower to be conductible with a spark plug. The elastic seal hermetically seals a gap between the high-voltage tower and the plug and also functions as a buffer to absorb stress, as exerted from the plug on a case of the ignition coil. This enables the case to be reduced in size as a whole without having to partially increase the wall thickness of the case to ensure a required degree of stiffness of the case and also results in improved degree of hermetic sealing between the plug and the high-voltage tower.

8 Claims, 10 Drawing Sheets

IGNITION COIL FOR INTERNAL COMBUSTION ENGINE

CROSS REFERENCE TO RELATED DOCUMENT

The present application claims the benefit of priority of Japanese Patent Application No. 2015-141852 filed on Jul. 16, 2015, the disclosure of which is incorporated herein by reference.

BACKGROUND

1. Technical Field

This disclosure relates generally to an ignition coil for an internal combustion engine.

2. Background Art

For instance, Japanese Patent No. 4209400 discloses an ignition coil for internal combustion engines which is equipped with a primary and a secondary coil magnetically coupled together and a case in which the primary and secondary coils are disposed. The case has a tubular high-voltage tower which extends toward the front end of the case. The high-voltage tower has a high-voltage output terminal which is press-fit therein and works to output high-voltage, as developed by the secondary coil. The case is filled with resin material which is disposed around a base end (i.e., a rear end) of the high-voltage output terminal to hermetically seal the primary and secondary coils.

In assembling of the ignition coil, the high-voltage output terminal is press-fitted in the base end of the high-voltage tower before the resin material is packed in the case, thereby avoiding escape of the resin material into the high-voltage tower when the resin material is packed in the case. Specifically, the high-voltage output terminal is press-fitted into the high-voltage tower to create a hermetical seal between itself and the case.

The ignition coil, as taught in the above publication, has the metallic high-voltage output terminal press-fitted directly into the high-voltage tower, thus resulting in an increased risk of stress is exerted by the high-voltage output terminal on the high-voltage tower. This leads to concern about damage, such as breakage or cracking, to the high-voltage tower, which usually results in risk of a failure in operation of the ignition coil. In order to alleviate this problem, the high-voltage tower is designed to have an increased wall thickness, however, this makes it difficult to reduce the overall size of the ignition coil.

SUMMARY

It is therefore an object to provide an ignition coil for internal combustion engines which is designed to alleviate mechanical stress acting on a case of the ignition coil and enables it to be reduced in size.

According to one aspect of the disclosure, there is provided an ignition coil for an internal combustion engine which comprises: (a) a primary coil and a secondary coil which are magnetically coupled together; (b) a case which includes a case body in which the primary coil and the secondary coil are disposed and a high-voltage tower which is of a cylindrical shape and extends from the case body; (c) a resinous filler which is packed in the case body to hermetically seal the primary coil and the secondary coil; (d) a plug which is disposed in the high-voltage tower to be electrically conductible in an axial direction of the ignition coil; and (e) an elastic seal which is of an annular shape and adhered to the plug and the high-voltage tower to hermetically seal a gap between the plug and the high-voltage tower.

The ignition coil is, as described above, equipped with the annular elastic seal which is adhered to the plug and the high-voltage tower to hermetically seal therebetween. The elastic seal, thus, functions as a buffer to absorb stress, as exerted from the plug on the case. This enables the case to be reduced in size as a whole without having to partially increase the wall thickness of the case to ensure a required degree of stiffness of the case and also results in an improved degree of hermetic sealing between the plug and the high-voltage tower.

The structure of the ignition coil, therefore, serves to minimize the mechanical stress acting on the case and enables to be reduced in size.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 10(*b*) is a sectional view which illustrates a second example of a high-voltage output terminal and an elastic seal in the seventh embodiment;

FIG. 10(*c*) is a sectional view which illustrates a third example of a high-voltage output terminal and an elastic seal in the seventh embodiment;

DESCRIPTION OF THE PREFERRED EMBODIMENT

First Embodiment

Figure 1:
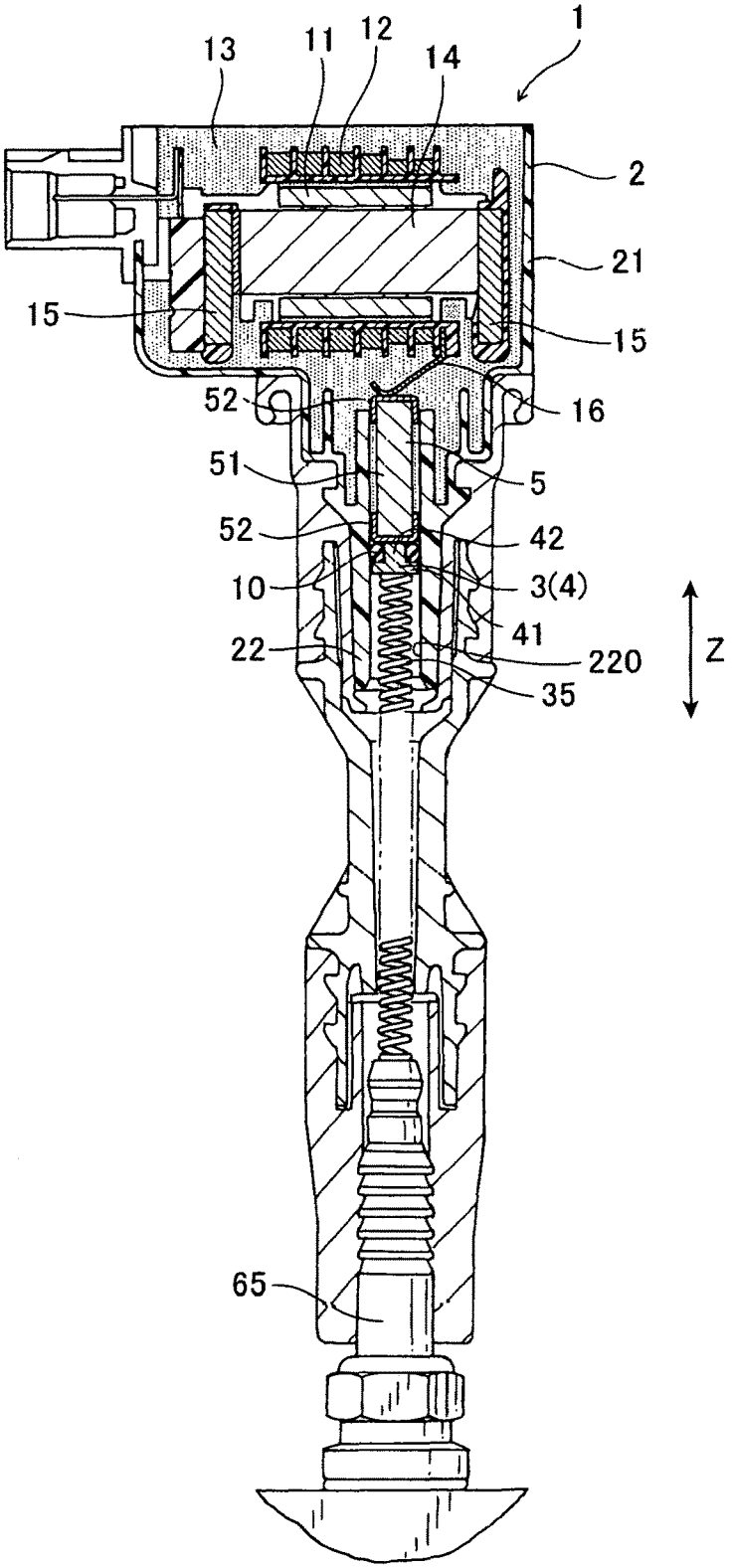
FIG. 1 is a longitudinal sectional view which illustrates an ignition coil according to the first embodiment.
Figure 2:
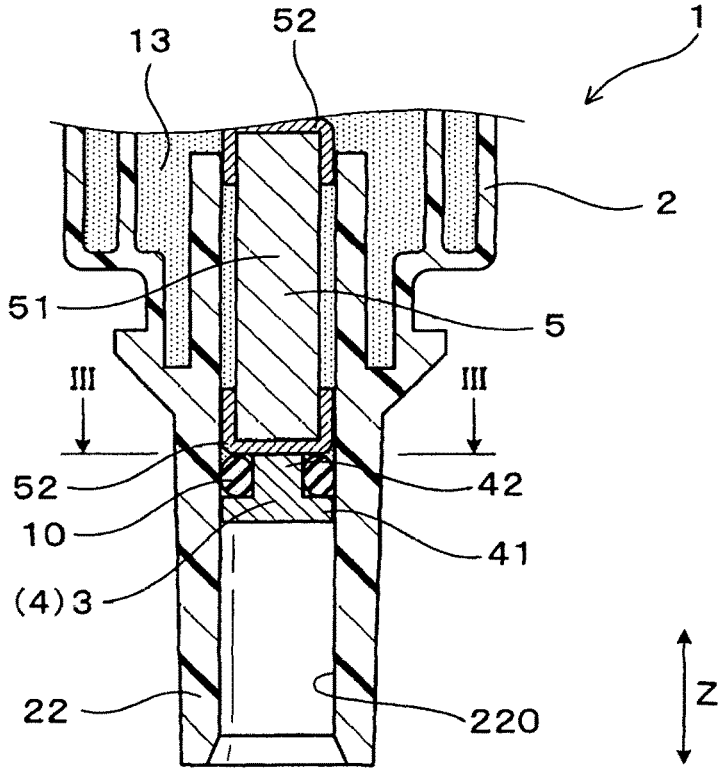
FIG. 2 is a sectional view which illustrates around a high-voltage tower of the ignition coil of FIG. 1.
Figure 3:
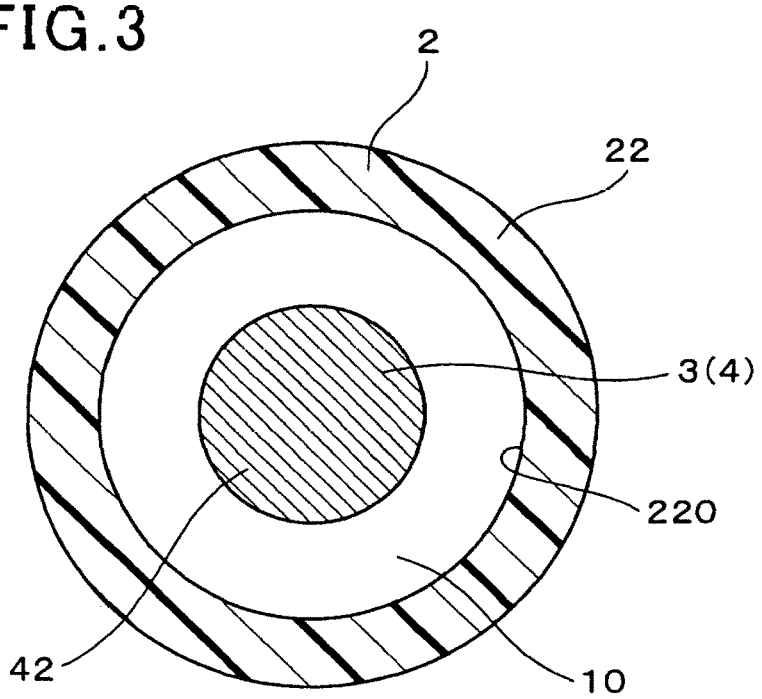
FIG. 3 is a sectional view, as taken along the line in FIG. 2.

Referring to the drawings, wherein like reference numbers refer to like parts in several views, particularly to FIGS. 1 to 3, there is shown an ignition coil 1 for internal combustion engines according to the first embodiment.

The ignition coil 1, as clearly illustrated in FIG. 1, includes the primary coil 11 and the secondary coil 12 which are magnetically coupled together, the case 2, the filled resin 13, the plug 3, and the elastic seal 10. The case 2 includes the case body 21 in which the primary coil 11 and the secondary coil 12 are disposed and the high-voltage tower 22 which is of a tubular shape and extends from the case body 21. The filled resin 13 which will also be referred to as a resinous filler below is packed in the case body 21 to hermetically seal the primary coil 11 and the secondary coil 12. The plug 3 is, as illustrated in FIGS. 1 and 2, mounted inside the high-voltage tower 22 and electrically conductible in the axial direction Z (i.e., a lengthwise direction of the ignition coil 1). The elastic seal 10 is, as clearly illustrated in FIGS. 1 to 3, of an annular shape and disposed in close contact with the plug 3 and the high-voltage tower 22 to hermetically seal a gap between the plug 3 and the high-voltage tower 22.

In use, the ignition coil 1 is connected to the spark plug 65 mounted in an internal combustion engine for automotive vehicles or cogeneration systems and works to apply high-voltage to the spark plug 65.

In this disclosure, a direction in which the high-voltage tower 22 of the case body 21 extends is referred to as the axial direction Z. The area to which the high-voltage tower 22 protrudes from the case body 21 in the axial direction Z is defined as a front end side. The area opposite the front end side in the axial direction Z is defined as a base end side or a rear end side.

The primary coil 11 and the secondary coil 12 are, as can be seen in FIG. 1, oriented to have inner and outer peripheral walls coaxially arranged to overlap each other. The center core 14 is disposed inside the primary coil 11 and the secondary coil 12. The center core 14 is made of soft magnetic material. The outer cores 15 are disposed outside the primary coil 11 and the secondary coil 12 and surround them in a direction perpendicular to the axial direction Z. The outer cores 15 are made of soft magnetic material.

The primary coil 11, the secondary coil 12, the center core 14, and the outer cores 15 are disposed in the case body 21. The high-voltage tower 22 protrudes from the case body 21 toward the front end side. The high-voltage tower 22 is of a substantially hollow cylindrical shape and has a through-hole 220 extending through a length thereof in the axial direction Z.

The plug 3 is, as illustrated in FIGS. 1 and 2, arranged inside the high-voltage tower 22. The plug 3 is made of metallic material. The plug 3 serves as a high-voltage output terminal 4 to output high-voltage, as developed by the secondary coil 12, from the ignition coil 1. The high-voltage output terminal 4 includes a disc-shaped large-diameter terminal 41 and a cylindrical small-diameter terminal 42 which is smaller in diameter than the large-diameter terminal 41. The small-diameter terminal 42 extends from the center of the large-diameter terminal 41 to the front end side. The diameter of the large-diameter terminal 41 of the high-voltage output terminal 4 is smaller than the inner diameter of the through hole 220 of the high-voltage tower 22. The elastic seal 10 is, as illustrated in FIGS. 1 to 3, fit on the outer periphery of the small-diameter terminal 42 of the high-voltage output terminal 4. The elastic seal 10 is of an annular shape. The elastic seal 10 is, as illustrated in FIGS. 1 and 2, located in contact with both the outer circumferential surface of the small-diameter terminal 42 and the base end surface (i.e., an upper surface, as viewed in FIGS. 1 and 2) of the large-diameter terminal 41. After fitted on the high-voltage output terminal 4, but before mounted in the high-voltage tower 22, the elastic seal 10 has an outer diameter greater than that of the large-diameter terminal 41 of the high-voltage output terminal 4. Additionally, after fitted on the high-voltage output terminal 4, but before mounted in the high-voltage tower 22, the elastic seal 10 has the outer diameter larger than the inner diameter of the high-voltage tower 22. The elastic seal 10 is made of a rubber O-ring.

The elastic seal 10 is, as illustrated in FIGS. 1 to 3, kept compressed in a radial direction thereof by the small-diameter terminal 42 and the high-voltage tower 22 between the high-voltage output terminal 4 and the high-voltage tower 22 to establish tight adhesion to the outer peripheral surface of the small-diameter terminal 42 of the high-voltage output terminal 4 and the inner peripheral surface of the high-voltage tower 22 in the radial direction of the elastic seal 10. The elastic seal 10, thus, produces elastic restoring force so that it is tightly pressed against the high-voltage output terminal 4 and the high-voltage tower 22. The whole circumference of the elastic seal 10 is in pressed contact with the entire outer circumference of the high-voltage output terminal 4 and the entire inner circumference of the high-voltage tower 22.

An assembly of the high-voltage output terminal 4 (the plug 3) and the elastic seal 10, as can be seen from FIGS. 1 and 2, serves to hermetically seal the high-voltage tower 22. The case 2 is filled with the resin 13 which is located closer to the base end side of the case 2 than the high-voltage output terminal 4 and the elastic seal 10 are.

The filled resin 13 functions to hermetically seal the primary coil 11, the secondary coil 12, the center core 14, and the outer cores 15. The filled resin 13 is made of, for example, epoxy resin.

The high-voltage tower 22 has disposed therein the resistor 5 which works to minimize an electrical current noise, as produced by the spark plug 65 joined to the ignition coil 1. The resistor 5 is located more inwardly within the case body 21 than the plug 3 (the high-voltage output terminal 4) is. The resistor 5 is hermetically sealed by the filled resin 13.

The resistor 5 includes the resistor body 51 and a pair of electrode caps 52. The resistor body 51 is made of a ceramic cylinder. The electrode caps 52 are made of metallic material and fit on ends of the resistor body 51 which are opposed to each other in the axial direction Z. One of the electrode caps 52 of the resistor 5 which is located closer to the front end side than the other is has a front end surface placed in contact with a base end surface of the high-voltage output terminal 4. The other electrode cap 52 which faces the base end side of the ignition coil 1 has a base end surface joined to the secondary coil 12 through the connector terminal 16, thereby establishing an electrical connection of the secondary coil 12 to the high-voltage output terminal 4 through the connector terminal 16 and the resistor 5.

The connector terminal 16 is made of metallic material and elastically deformable in the axial direction Z. The connector terminal 16 produces a restoring force to press the resistor 5 and the high-voltage output terminal 4 toward the front end side, thereby establishing physical and electrical contacts between the connector terminal 16 and the resistor 5 and between the resistor 5 and the high-voltage output terminal 4.

The resin 13 is packed within a portion of an inner chamber of the case 2 which is closer to the base end side of the case 2 than the high-voltage output terminal 4 and the elastic seal 10 are. The resin 13 also occupies a gap between the resistor 5 and the inner peripheral surface of the high-voltage tower 22 within the high-voltage tower 22.

The spring 35 is disposed in contact with the front end surface of the high-voltage terminal 4 within the high-voltage tower 22 for electrically connecting between the ignition coil 1 and the spark plug 65 through the front end of the high-voltage output terminal 4.

The operation of and beneficial effects, as offered by the ignition coil 1 of this embodiment, will be described below.

The ring-shaped elastic seal 10 is, as described above, tightly adhered to the high-voltage output terminal 4 and the high-voltage tower 22 to hermetically seal a gap between the high-voltage output terminal 4 and the high-voltage tower 22. The elastic seal 10, thus, functions as a buffer to absorb stress, as exerted by the high-voltage output terminal 4 on the case 2. This enables the case 2, i.e., the ignition coil 1 to be reduced in size as a whole without having to partially increase the wall thickness of the case 2 to ensure a required degree of stiffness of the case 2 and also results in improved degree of hermetic sealing between the high-voltage output terminal 4 and the high-voltage tower 22.

The plug 3 is made of conductive material such as metallic material, thus establishing an electrical conductivity at the ends of the plug 3 which are opposed to each other in the axial direction Z.

The resistor 5 is sealed by the filled resin 13, thus blocking transmission of mechanical vibration from the ignition coil 1 to the case 2. The resistor 5 and the high-voltage output terminal 4 are, therefore, kept in contact with each other by the filled resin 13 to ensure the stability in electrical connection between the resistor 5 and the high-voltage output terminal 4. Additionally, the resistor 5 is covered with the filled resin 13, thus minimizing the risk of corrosion thereof to improve the durability of the resistor 5.

The elastic seal 10 is retained between the large-diameter terminal 41 of the high-voltage output terminal 4 and the resistor 5 tightly in the axial direction Z, thereby avoiding a shift in location thereof from the high-voltage output terminal 4.

The installation of the elastic seal 10 with which the high-voltage output terminal 4 is assembled may be achieved by inserting the elastic seal 10 into the high-voltage tower 22 from outside either of the front end or the rear end of the high-voltage tower 22. When the high-voltage output terminal 4 on which the elastic seal 10 is already fit is required to be mounted in the high-voltage tower 22 from outside the front end thereof, the high-voltage output terminal 4 with the elastic seal 10 is inserted into the high-voltage tower 22 after the resistor 5 is disposed in the high-voltage tower 22. The elastic seal 10 is pushed to a given location within the high-voltage tower 22 while being pressed at the front end by the large-diameter terminal 41 of the high-voltage output terminal 4. This ensures the stability in installation of the elastic seal 10 in place within the high-voltage tower 22 without any misalignment thereof.

When it is required to insert the high-voltage output terminal 4 on which the elastic seal 10 is already fit into the high-voltage tower 22 from outside the rear end thereof, the high-voltage output terminal 4 is pushed at the rear end thereof by the resistor 5. Specifically, the elastic seal 10 is pushed to a given location within the high-voltage tower 22 while being grabbed between the large-diameter terminal 41 of the high-voltage output terminal 4 and the resistor 5. This achieves smooth installation of the elastic seal 10 in place within the high-voltage tower 22 without any misalignment thereof.

As apparent from the above discussion, the ignition coil for internal combustion engines is provided which is capable of alleviating the stress acting on the case 2 and being reduced in size.

Second Embodiment

Figure 4:
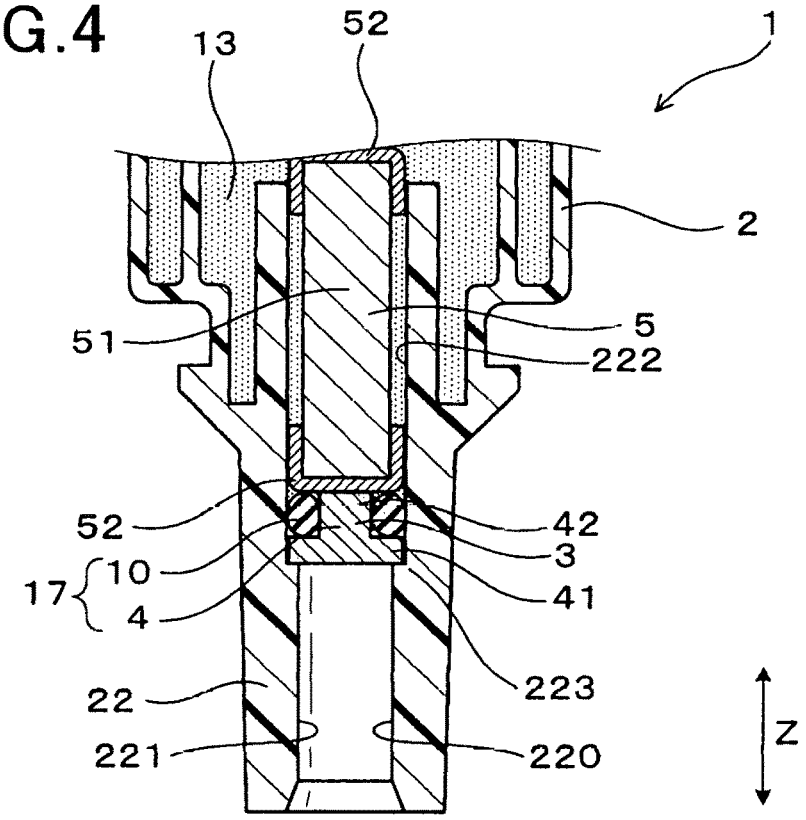
FIG. 4 is a sectional view which illustrates around a high-voltage tower of an ignition coil of the second embodiment.

The ignition coil 1 of this embodiment is, as illustrated in FIG. 4, designed to have a positioning mechanism which positions the high-voltage output terminal 4 relative to the high-voltage tower 22.

The through-hole 220 formed in the high-voltage tower 22 includes portions which are arranged in the axial direction Z and different in inner diameter from each other. Specifically, the through hole 220 of the high-voltage tower 22 has a length made up of a front hole portion 221 and the rear hole portion 222. The front hole portion 221 is closer to the front end of the ignition coil 1 than the rear hole portion 222 is. The rear end hole portion 222 has an inner diameter greater than that of the front hole portion 221. The high-voltage tower 22 also includes the shoulder 223 formed between the front hole portion 221 and the rear hole portion 222 which are aligned with each other in the axial direction Z.

The front end surface of the large-diameter terminal 41 of the high-voltage output terminal 4 is placed in contact with the surface of the shoulder 223 which faces the rear end of the ignition coil 1. This ensures the stability in positioning the high-voltage output terminal 4 relative to the high-voltage tower 22 in the axial direction Z, that is, achieves exact alignment of the high-voltage output terminal 4 with the high-voltage tower 22 in the axial direction Z.

After the elastic seal 10 is fitted on the high-voltage output terminal 4, but before installed in the high-voltage tower 22, the outer diameter of the elastic seal 10 is greater than the inner diameter of the rear hole portion 222. The elastic seal 10 is adhered close to the outer peripheral surface of the high-voltage output terminal 4 and the inner peripheral surface of the high-voltage tower 22 to hermetically seal a gap therebetween.

Next, an example of how to assemble the high-voltage output terminal 4 and the elastic seal 10 in the high-voltage tower 2 will be described below.

First, the assembly 17 of the high-voltage output terminal 4 and the elastic seal 10 is prepared by fitting the elastic seal 10 on the small-diameter portion 42 from the base end (i.e., the rear end) of the high-voltage output terminal 4. Subsequently, the assembly 17 is press-fitted into the high-voltage tower 22 from outside the based end of the high-voltage tower 22. Specifically, the assembly 17 is pushed into the high-voltage tower 22 until the front end surface of the high-voltage output terminal 4 reaches the shoulder 223. The contact of the front end surface of the high-voltage output terminal 4 with the shoulder 223 achieves alignment of the assembly 17 in the axial direction Z within the high-voltage tower 22.

Other arrangements of the ignition coil 1 are identical with those in the first embodiment. In the second and following embodiments, the same reference numbers, as employed in the first embodiment refer to the same parts unless otherwise specified.

As apparent from the above discussion, the ignition coil 1 of the second embodiment is capable of facilitating the alignment of the high-voltage output terminal 4 with the high-voltage power 22 in the axial direction Z.

The second embodiment offers the same other beneficial advantages as those in the first embodiment.

Third Embodiment

Figure 5:
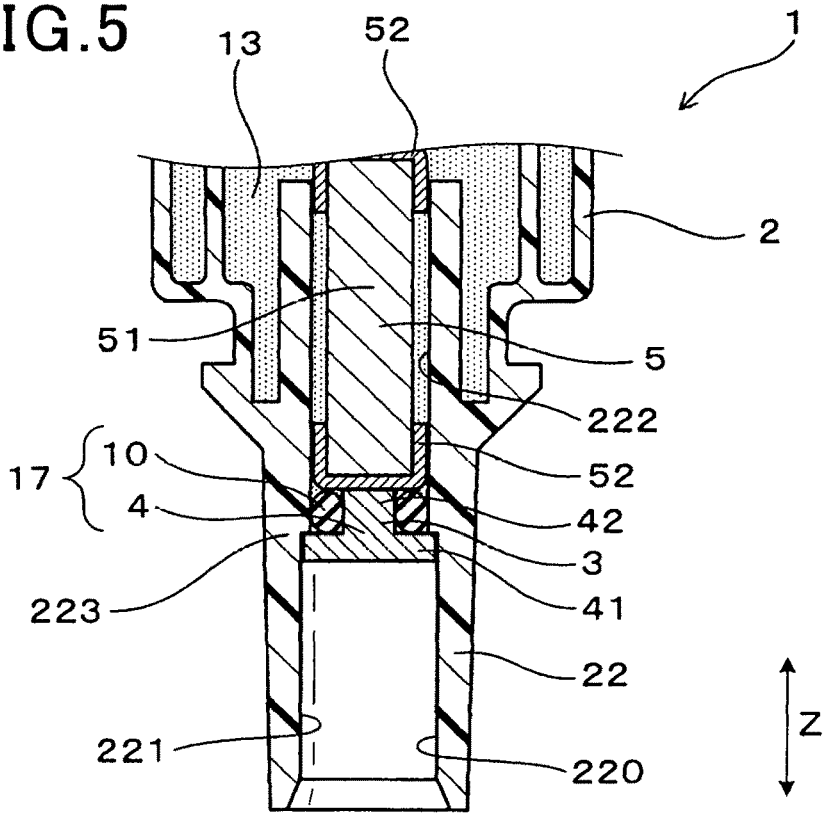
FIG. 5 is a sectional view which illustrates the region around a high-voltage tower of an ignition coil of the third embodiment.

This embodiment is, as can be seen in FIG. 5, a modification of the second embodiment.

The front hole portion 221 of the through hole 220 of the high-voltage tower 22 has an inner diameter which is greater than that of the rear hole portion 222.

The base end surface of the large-diameter terminal 41 of the high-voltage output terminal 4 is placed in abutment with the shoulder 223. Specifically, the high-voltage output terminal 4 is in contact with the front end of the shoulder 223, thereby ensuring the alignment of the high-voltage output terminal 4 with the high-voltage tower 22 in the axial direction Z.

The outer diameter of the elastic seal 10 is greater than the inner diameter of the rear hole portion 222 of the high-voltage tower 22, but smaller than the inner diameter of the front hole portion 221. The elastic seal 10 is tightly adhered to the outer circumferential surface of the high-voltage output terminal 4 and the inner circumferential surface of the high-voltage tower 22 to hermetically seal a gap therebetween.

An example of how to assemble the high-voltage output terminal 4 and the elastic seal 10 in the high-voltage tower 2 will be described below.

First, the assembly 17 of the high-voltage output terminal 4 and the elastic seal 10 is, like in the second embodiment, prepared by fitting the elastic seal 10 on the small-diameter portion 42 from the base end (i.e., the rear end) of the high-voltage output terminal 4. Subsequently, the assembly 17 is press-fitted into the high-voltage tower 22 from outside the front end of the high-voltage tower 22. Specifically, the assembly 17 is pushed into the high-voltage tower 22 until the rear end surface (i.e., the base end surface) of the high-voltage output terminal 4 reaches the shoulder 223. The insertion of the assembly 17 into the front hole portion 221 is easily achieved by a decreased pressure without having to be press-fitted thereinto until the elastic seal 10 travels in the axial direction Z and reaches the shoulder 223 because the outer diameter of the elastic seal 10 of the assembly 17 is smaller than the inner diameter of the front hole portion 221.

Afterward, the assembly 17 is press-fitted into the rear hole portion 222 until the base end surface of the large-diameter terminal 41 of the high-voltage output terminal 4 reaches the shoulder 223, thereby ensuring the alignment of the assembly 17 with the high-voltage tower 22 in the axial direction Z.

Other arrangements of the ignition coil 1 are the same as those in the second embodiment, and explanation thereof in detail will be omitted here.

The structure of the ignition coil 1 of this embodiment facilitates the ease with which the high-voltage output terminal 4 and the elastic seal 10 are installed in the high-voltage tower 22. Specifically, the structure of the ignition coil 1 obviates the need for press-fitting the assembly 17 into the high-voltage tower 22 from outside the front end thereof until the elastic seal 10 reaches near where the elastic seal 10 should be finally positioned in the high-voltage tower 22 (i.e., the shoulder 223). This permits a length of a portion of the high-voltage tower 22 into which the assembly 17 needs to be press-fitted to be shortened to reduce a degree of pressure required to push the assembly 17 into the high-voltage tower 22, thereby facilitating the ease with which the assembly 17 is installed in the high-voltage tower 22.

Fourth Embodiment

Figure 6:
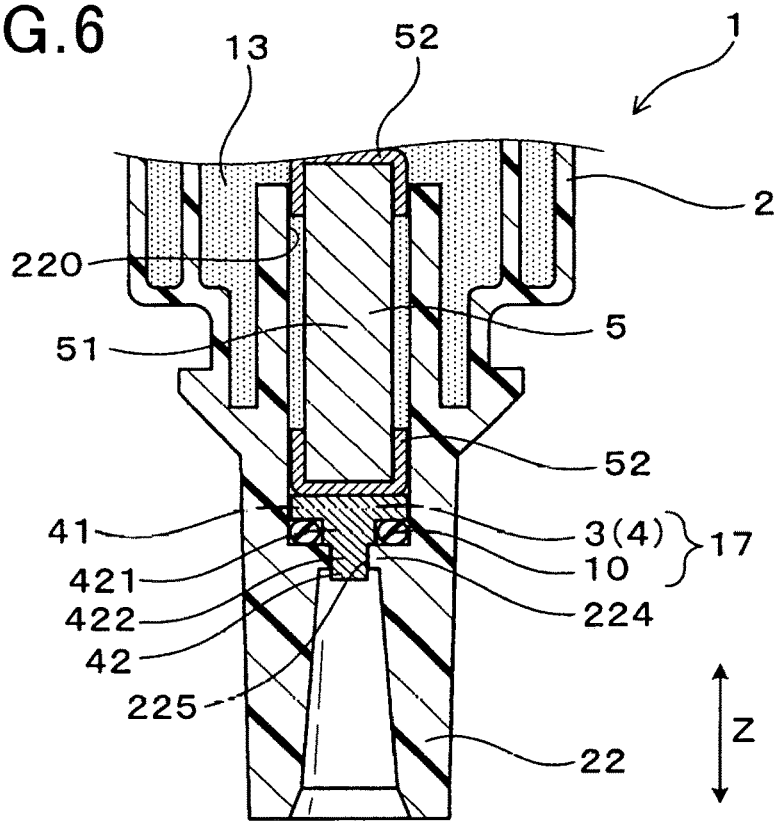
FIG. 6 is a sectional view which illustrates the region around a high-voltage tower of an ignition coil of the fourth embodiment.

The elastic seal 10 of this embodiment is, as illustrated in FIG. 6, different from the above embodiments in an orientation in which the elastic seal 10 is adhered closely to the high-voltage tower 22 and the high-voltage output terminal 4. Specifically, the elastic seal 10 is tightly adhered to the high-voltage output terminal 4 and the high-voltage tower 22 in the axial direction Z.

The high-voltage tower 22 includes an annular protrusion 224 extending from the inner periphery of the high-voltage tower 22 in the radial direction thereof. The annular protrusion 224 is of a circular ring-shape. The high-voltage tower 22 has formed therein a through hole 225 extending in the axial direction Z to define the circular ring-shape of the annular protrusion 224.

The high-voltage output terminal 4 is made up of the large-diameter terminal which is of a disc shape and the small-diameter terminal 42 which protrudes from the center of the large-diameter terminal 41 toward the front end of the high-voltage tower 22. The small-diameter terminal 42 has portions which are arranged in the axial direction Z and different in diameter from each other. Specifically, the small-diameter terminal 42 includes a terminal contact portion 421 and a terminal insertion portion 422. The terminal contact portion 421 is located closer to the base end of the ignition coil 1 than the terminal insertion portion 422. The terminal insertion portion 422 protrudes from the radial center of the terminal contact portion 421 toward the front end of the ignition coil 1 and has a diameter smaller than that of the terminal contact portion 421.

The front end surface of the terminal contact portion 421 of the high-voltage output terminal 4 is placed in contact with the base end surface of the annular protrusion 224. Specifically, the high-voltage output terminal 4 is seated directly on the rear end surface (i.e., the base end surface) of the annular protrusion 224, thereby ensuring the alignment of the high-voltage output terminal 4 with the high-voltage tower 22 in the axial direction Z.

The terminal insertion portion 422 of the high-voltage output terminal 4 is inserted into the hole 225 of the annular protrusion 224 to have a head placed outside the annular protrusion 224, so that the high-voltage output terminal 4 can contact with the spring 35 (not shown in FIG. 6) mounted on the front end side of the ignition coil 1 to achieve an electrical conduction therewith. The high-voltage tower 22 has a portion which is closer to the front end of the ignition coil 1 than the annular protrusion 224 is and which has an inner diameter increasing toward the base end of the ignition coil 1 (i.e., the high-voltage tower 22), thereby facilitating the ease with which the high-voltage output terminal 4 contacts with the spring 35 which is inserted from outside the high-voltage output terminal 4.

The annular elastic seal 10 is disposed around the outer circumference of the terminal contact portion 421 of the high-voltage output terminal 4. The elastic seal 10 is placed in contact with the outer circumferential surface of the terminal contact portion 421 and the front end surface of the large-diameter terminal 41. The elastic seal 10 has a thickness in the axial direction Z, and is longer than that of the terminal contact portion 421 at least when the elastic seal 10 is not subjected to elastic pressure, in other words, not compressed. After fitted on the high-voltage output terminal 4, but before installed in the high-voltage tower 22, the elastic seal 10 has an outer diameter smaller than an inner diameter of a portion of the high-voltage tower 22 which is closer to the base end of the high-voltage tower 22 than the annular protrusion 224 is.

The elastic seal 10 is compressed by both the large-diameter terminal 41 and the high-voltage tower 22 in the axial direction Z between the high-voltage output terminal 4 and the high-voltage tower 22, so that it is tightly adhered to the front end surface of the large-diameter terminal 41 of the high-voltage output terminal 4 and the base end surface of the annular protrusion 224 in the axial direction Z. Before the case 2 is filled with the resin 13, the elastic seal 10 is compressed in the axial direction Z by the high-voltage output terminal 4 which is pushed toward the front end of the ignition coil 1 by the restoring force of the connector terminal 16 through the resistor 5. The elastic seal 10 has the whole of its circumference fully pressed against the front end surface of the large-diameter terminal 41 of the high-voltage output terminal 4 and the base end surface of the annular protrusion 224.

Other arrangements of the ignition coil 1 are the same as those in the second embodiment, and explanation thereof in detail is omitted here.

The ignition coil 1 of the fourth embodiment, as described above, has the elastic seal 10 interposed between the annular protrusion 224 and the high-voltage output terminal 4 in the axial direction Z. The high-voltage output terminal 4 is pushed toward the front end of the ignition coil 1 to press the elastic seal 10 tightly against the high-voltage tower 22 and the high-voltage output terminal 4. This eliminates the need for press-fitting the assembly 17 made up of the high-voltage output terminal 4 and the elastic seal 10 into the high-voltage tower 22, thus obviating the need for the high-voltage tower 22 to have a wall thickness increased in the radial direction thereof and enabling the high-voltage tower 22 to be reduced in size.

The structure of the ignition coil 1 of this embodiment offers the same other advantages as those in the first embodiment.

The elastic seal 10 of this embodiment is, as described above, designed to have the diameter which is smaller than the inner diameter of a portion of the high-voltage tower 22 which is located closer to the base end of the high-voltage tower 22 than the annular protrusion 224 is after fitted on the high-voltage output terminal 4, but before installed in the high-voltage tower 22, but may alternatively be modified to have another dimensional relation to the high-voltage tower 22.

Fifth Embodiment

Figure 7:
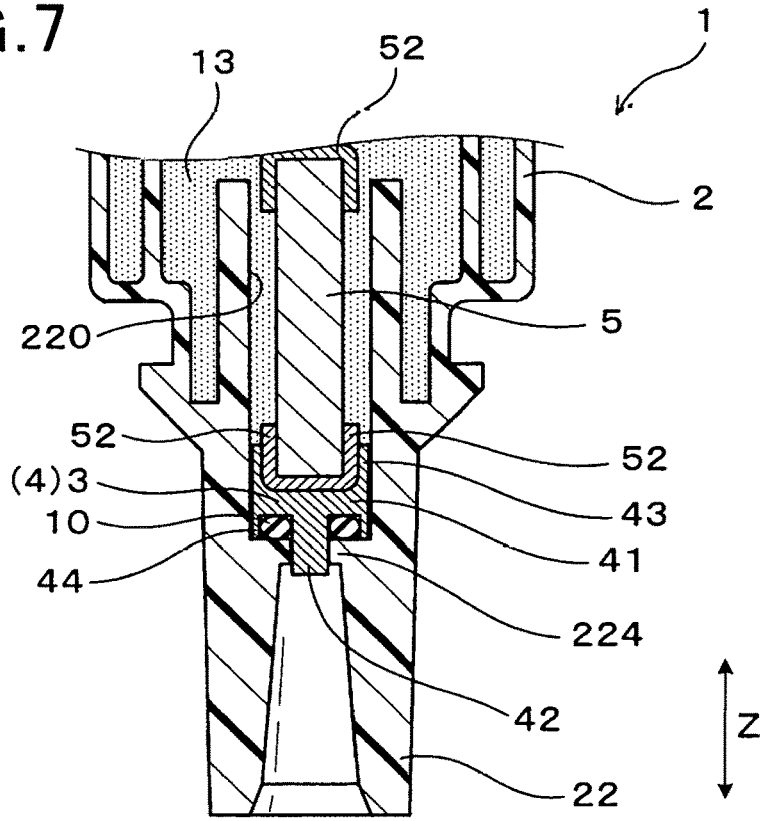
FIG. 7 is a sectional view which illustrates the region around a high-voltage tower of an ignition coil of the fifth embodiment.

The ignition coil 1 of this embodiment, as illustrated in FIG. 7, has the high-voltage output terminal 4 designed to have a mechanism which retains the resistor 5 and the elastic seal 10. Other arrangements of the high-voltage tower 22 are the same as those in the fourth embodiment.

The high-voltage output terminal 4 includes a cylindrical resistor holder 43 and a cylindrical seal holder 44. The resistor holder 43 has a hollow cylindrical wall extending from an outer circumferential edge of the large-diameter terminal 41 toward the base end of the ignition coil 1. The seal holder 44 has a hollow cylindrical wall extending from the outer circumferential edge of the large-diameter terminal 41 toward the front end of the ignition coil 1. The resistor holder 43 surrounds the outer circumferential surface of the electrode cap 52 of the resistor 5. The seal holder 44 is placed in contact with, in other words, seated on the base end surface of the annular protrusion 224 of the high-voltage tower 22, thereby achieving the alignment of the high-voltage output terminal 4 with the high-voltage tower 22 in the axial direction Z.

The alignment of the resistor 5 with the high-voltage output terminal 4 is achieved by fitting the front electrode cap 52 into a cylindrical chamber of the high-voltage output terminal 4, as defined by the resistor holder 43 and the large-diameter terminal 41, from outside the base end of the high-voltage output terminal 4. The elastic seal 10 is fitted from outside the front end of the high-voltage output terminal 4 into a cylindrical chamber, as defined by the seal holder 44, the large-diameter terminal 41, and the small-diameter terminal 42, thereby ensuring the alignment of the elastic seal 10 with the high-voltage output terminal 4.

Other arrangements are identical with those in the fourth embodiment, and explanation thereof in detail will be omitted here.

The structure of the ignition coil 1 facilitates the ease with which the resistor 5 is aligned with the high-voltage output terminal 4 and also ensures the stability in achieving an electrical contact between the high-voltage output terminal 4 and the resistor 5.

The structure of the ignition coil 1 of this embodiment offers the same other advantages as those in the first embodiment.

Sixth Embodiment

Figure 8:
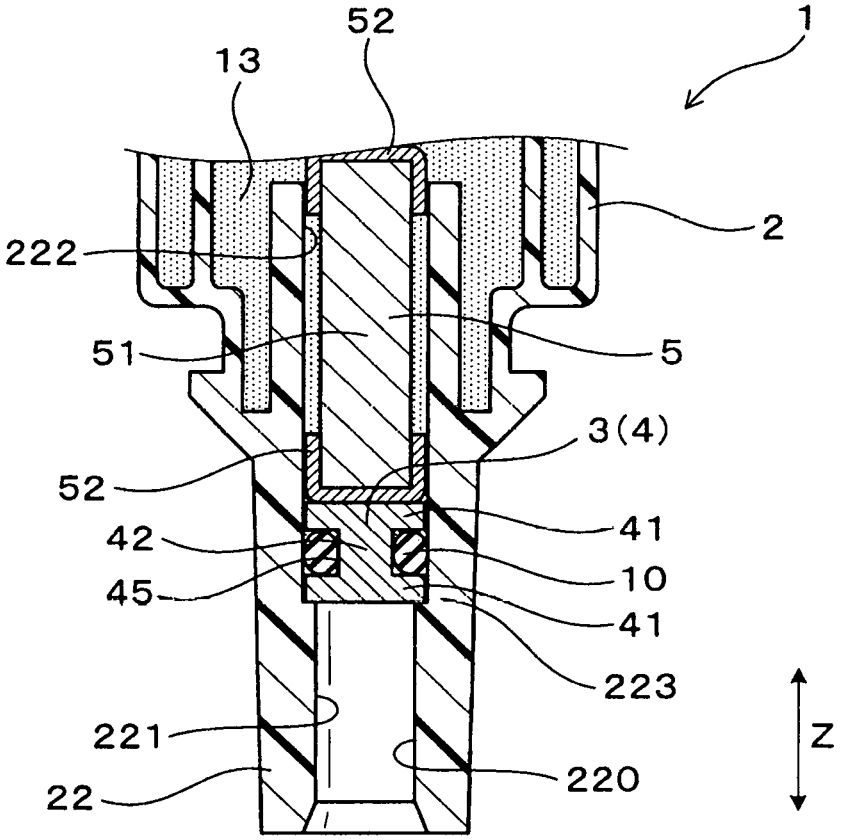
FIG. 8 is a sectional view which illustrates the region around a high-voltage tower of an ignition coil of the sixth embodiment.

The ignition coil 1 of this embodiment is, as clearly illustrated in FIG. 8, designed to have the high-voltage output terminal 4 which is symmetrical in shape vertically (i.e., the axial direction Z). In other words, the high-voltage output terminal 4 has a length made up of a front portion and a rear portion which are symmetrical in shape with respect to a line extending radially through the center of the length thereof.

Specifically, the high-voltage output terminal 4 includes the two large-diameter terminals 41 (which will also be referred to below as upper and lower large-diameter terminals) and the small-diameter terminal 42. The upper and lower large-diameter terminals 41 are of a disc shape and separated from each other in the axial direction Z. The small-diameter terminal 42 is of a cylindrical shape and extends in the axial direction Z to connect the radial centers of the upper and lower large-diameter terminals 41. In other words, the high-voltage output terminal 4 has the annular groove 45 formed in a central circumference thereof in the axial direction Z. The annular groove 45 is of a ring-shape and continues around the whole circumference of the high-voltage output terminal 4.

The annular elastic seal 10 is fit in the annular groove 45 formed between the upper and lower large-diameter terminals 41, in other words, on the circumference of the small-diameter terminal 42.

Other arrangements are identical with those in the second embodiment, and explanation thereof in detail is omitted here.

The shape of the high-voltage output terminal 4 which is symmetrical along the lateral line extending through the midpoint of the length thereof decreases the number of assembling processes of the ignition coil 1, that is, enables the step of distinguishing between the upside and downside of the high-voltage output terminal 4 to be omitted to facilitate the assembling of the ignition coil 1, thus improving the efficiency in assembling the ignition coil 1. In other words, the installation of the high-voltage output terminal 4 in the high-voltage tower 22 is achieved without the need for discriminating between the upside and downside of the high-voltage output terminal 4.

The annular groove 45 of the high-voltage output terminal 4 facilitates the installation of the elastic seal 10 on the high-voltage output terminal 4.

The structure of the ignition coil 1 of this embodiment offers the same other advantages as those in the second embodiment.

Figure 9:
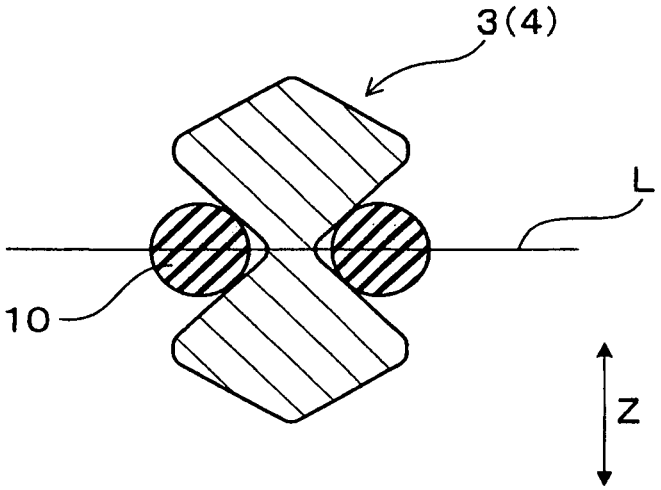
FIG. 9 is a sectional view which a modification of the high-voltage tower of the sixth embodiment in FIG. 8.

The configuration of the high-voltage output terminal 4 may be modified in various ways. For instance, the high-voltage output terminal 4 may be shaped, as illustrated in FIG. 9, to have a cross section, as taken along the longitudinal center line thereof, which is symmetrical with respect to a line L extending perpendicular to the axial direction Z. Half the cross section on each side of the line L is of a substantially diamond shape. In brief, the high-voltage output terminal 4 may be formed to have a variety of shapes as long as it is vertically symmetrical in shape.

Seventh Embodiment

Figure 10A:
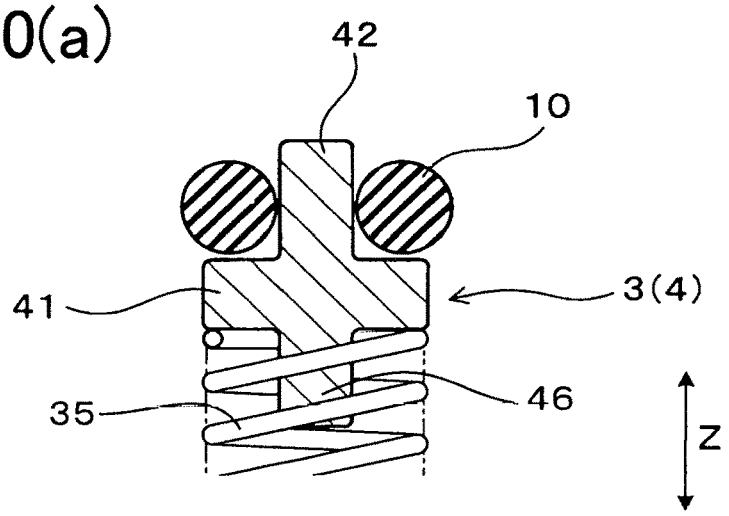
FIG. 10(*a*) is a sectional view which illustrates a first example of a high-voltage output terminal and an elastic seal in the seventh embodiment.
Figure 10B:
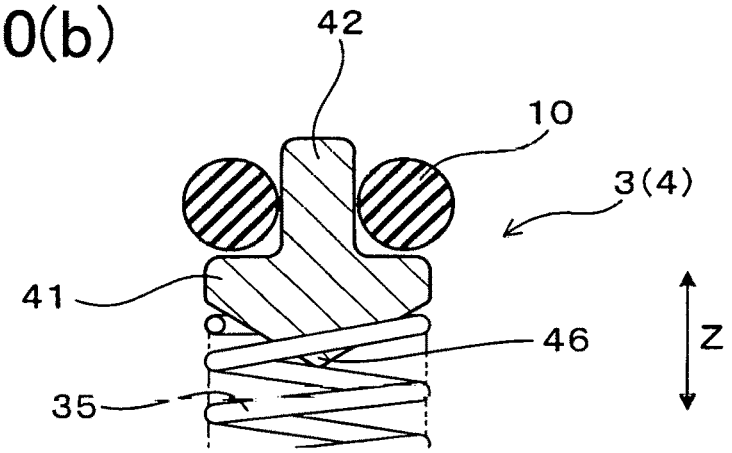
Figure 10C:
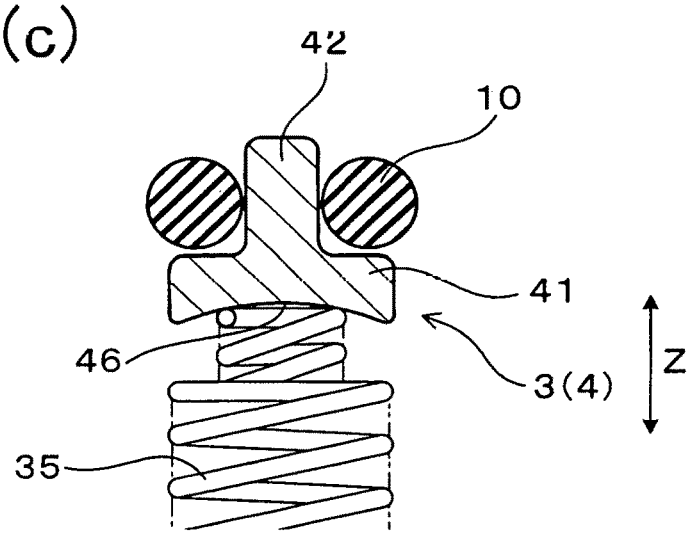

The ignition coil 1 of this embodiment is, as illustrated in FIGS. 10(*a*) to 10(*c*), designed to have the spring holder 46 formed on the front end of the high-voltage output terminal 4. The spring holder 46 is used to retain the spring 35 which is disposed in and outside the top end (i.e., the lower end, as viewed in the drawing) of the high-voltage output terminal 4 and placed in contact with the top end of the high-voltage output terminal 4. The spring holder 46 also works to ensure the alignment of the spring 35 with the high-voltage output terminal 4 in the axial direction Z.

In the example of FIG. 10(*a*), the high-voltage output terminal 4, like in the first embodiment, includes the disc-shaped large-diameter terminal 41 and the cylindrical small-diameter terminal 42 which extends from the center of the large-diameter terminal 41 toward the base end of the ignition coil 1. The high-voltage output terminal 4 has the cylindrical spring holder 46 protruding from the radial center thereof toward the front end of the ignition coil 1. The spring holder 46 of the high-voltage output terminal 4 is arranged in the spring 35. The high-voltage terminal 4 is placed in contact with the spring 35. Specifically, the high-voltage output terminal 4 is arranged to have the front end surface thereof in mechanical and electrical contact with the end of the spring 35. This avoids the misalignment of the spring 35 with the high-voltage output terminal 4 in the radial direction of the high-voltage output terminal 4 and also ensures the stability in establishing an electrical contact between the spring 35 and the high-voltage output terminal 4.

In the example of FIG. 10(*b*), the large-diameter terminal 41 of the high-voltage output terminal 4 has a conical front portion which tapers toward the front end of the high-voltage output terminal 4. The conical front portion of the large-diameter terminal 41 defines the spring holder 46. The spring holder 46 is partially placed in mechanical and electrical contact with the inner periphery of the end of the spring 35, thereby eliminating the misalignment of the spring 35 with the high-voltage output terminal 4 in the radial direction of the high-voltage output terminal 4 and also ensures the stability in establishing the electrical contact between the spring 35 and the high-voltage output terminal 4.

In the example of FIG. 10(*c*), the large-diameter terminal 41 of the high-voltage output terminal 4 has a concave front end which inwardly curves, for example, at a given radius of curvature to have the radial center located closest to the base end (i.e., the upper end, as viewed in the drawing) of the high-voltage output terminal 4. The concave front end of the large-diameter terminal 41 defines the spring holder 46. The spring holder 46 (i.e., the concave front end) holds the spring 35 through mechanical contact between the surface of the concave front end and the end of the spring 35. This avoids the misalignment of the spring 35 with the high-voltage output terminal 4 in the radial direction and also ensures the stability in establishing the electrical contact between the spring 35 and the high-voltage output terminal 4.

Other arrangements of the ignition coil 1 of this embodiment are the same as those in the first embodiment. The structure of the ignition coil 1 of this embodiment offers the same other advantages as those in the first embodiment.

Eighth Embodiment

Figure 11:
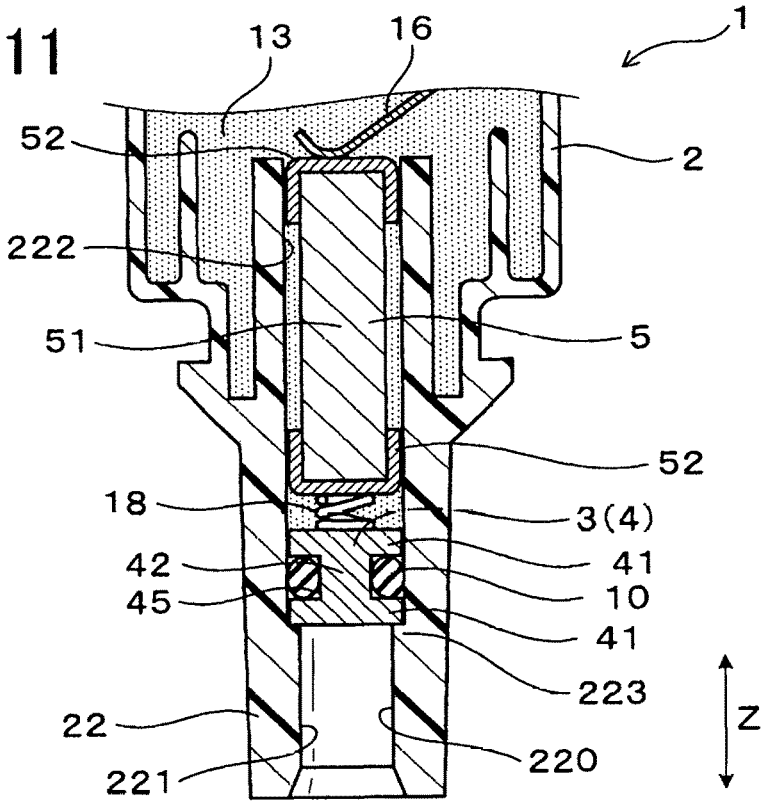
FIG. 11 is a sectional view which illustrates around a high-voltage tower of an ignition coil in the eighth embodiment.

The ignition coil 1 of this embodiment, as illustrated in FIG. 11, has the coil spring 18 disposed between the resistor 5 and the high-voltage output terminal 4. The spring 18 is made of an elastic material formed into the shape of a helix whose axis extending in the axial direction Z. The spring 18 is elastically deformable in the axial direction Z. The spring 18 is compressed by the resistor 5 and the high-voltage output terminal 4 to produce a restoring force which ensures the stability in mechanical and electrical contact between the resistor 5 and the high-voltage output terminal 4. FIG. 11 illustrates a front view of the spring 18.

Other arrangements are identical with those in the sixth embodiment.

The spring 18 produces a restoring energy to absorb variations in dimension of the resistor 5, the high-voltage output terminal 4, etc., in the axial direction Z, thereby ensuring the stability in mechanical and electrical contact between the resistor 5 and the high-voltage output terminal 4.

Figure 12:
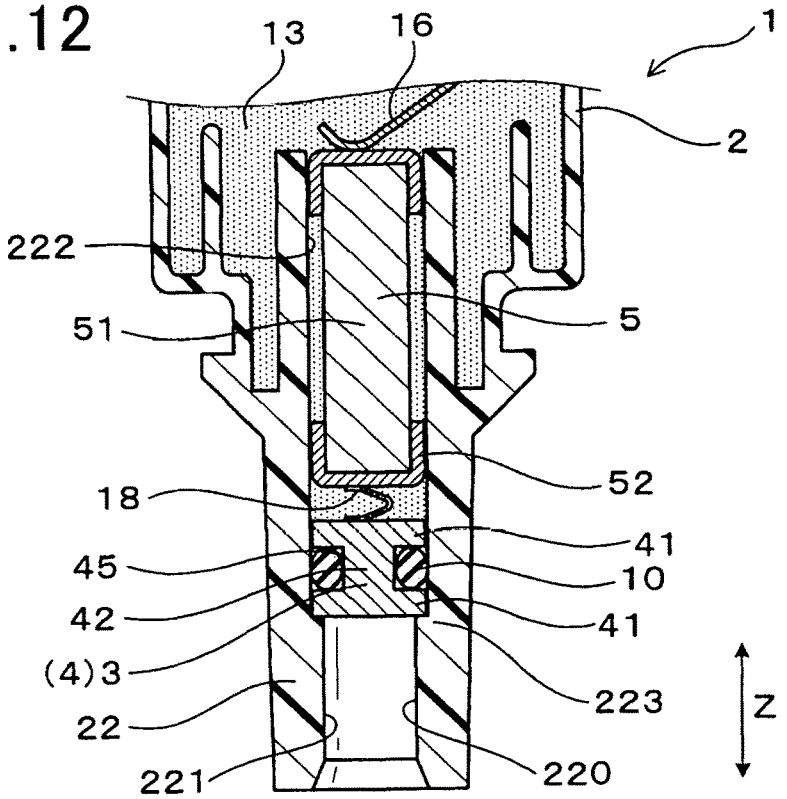
FIG. 12 is a sectional view which illustrates a modification of the high-voltage tower of the eighth embodiment in FIG. 11.

The ignition coil 1 of this embodiment also offers the same other advantages as those in the sixth embodiment. The spring 18 is, as described above, wound helically in the axial direction Z, but however, may be, as illustrated in FIG. 12, made of a plate spring elastically deformable in the axial direction Z.

Ninth Embodiment

Figure 13:
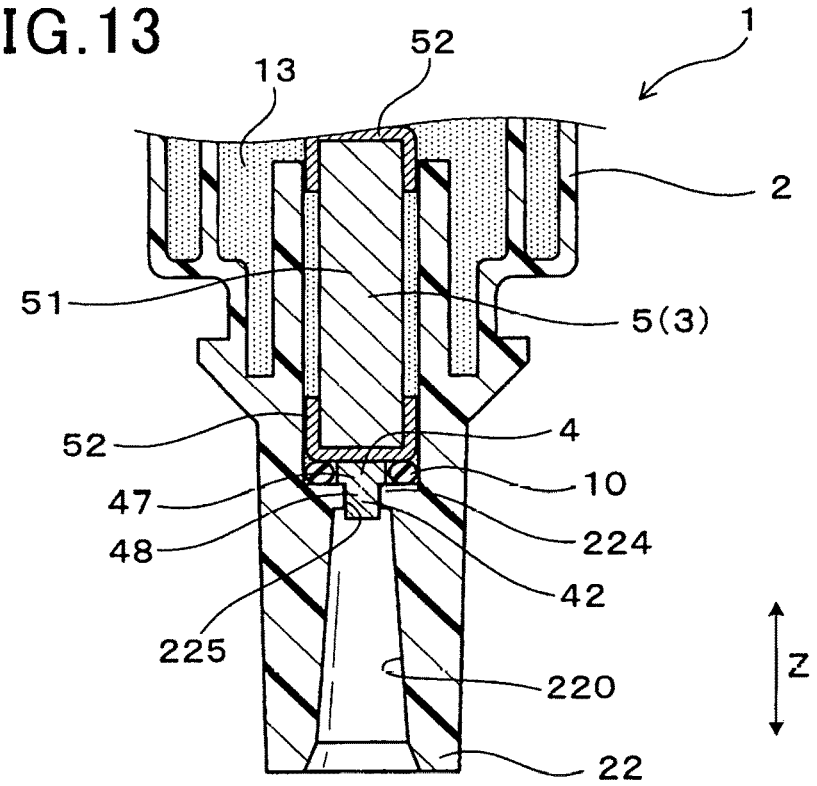
FIG. 13 is a sectional view which illustrates the region around a high-voltage tower of an ignition coil in the ninth embodiment.

The ignition coil 1 of this embodiment, as illustrated in FIG. 13, has the plug 13 working as the resistor 5.

The high-voltage tower 22 has substantially the same structure as in the fourth embodiment. The high-voltage output terminal 4 has portions which are aligned in the axial direction Z and have diameters different from each other. Specifically, the high-voltage output terminal 4 includes the terminal contact portion 47 and the terminal insertion portion 48. The terminal insertion portion 48 extends from the radial center of the terminal contact portion 47 toward the front end of the ignition coil 1. The terminal insertion portion 48 is smaller in diameter than the terminal contact portion 47.

The annular elastic seal 10 is fit on the outer circumference of the terminal contact portion 47 of the high-voltage output terminal 4. The elastic seal 10 is compressed in the axial direction Z by the electrode cap 52 and the high-voltage tower 22 between the resistor 5 and the high-voltage tower 22 and tightly attached to the front end surface of the front electrode cap 52 of the resistor 5 and the base end surface of the annular protrusion 224. The elastic seal 10 has a whole circumference adhered fully both to the front end of the electrode cap 52 of the resistor 5 and to the base end of the annular protrusion 224.

Other arrangements are identical with those in the fourth embodiment.

The plug 3 of this embodiment, as described above, designed as the resistor 5. The elastic seal 10 is placed in close contact with the resistor 5 and the high-voltage tower 22 to hermetically seal a gap therebetween, thereby alleviating the stress acting on the case 2 and enabling the ignition coil 1 for internal combustion engines to be reduced in size.

The structure of the coil spring 1 of this embodiment also offers the same other advantages as in the fourth embodiment.

Tenth Embodiment

Figure 14:
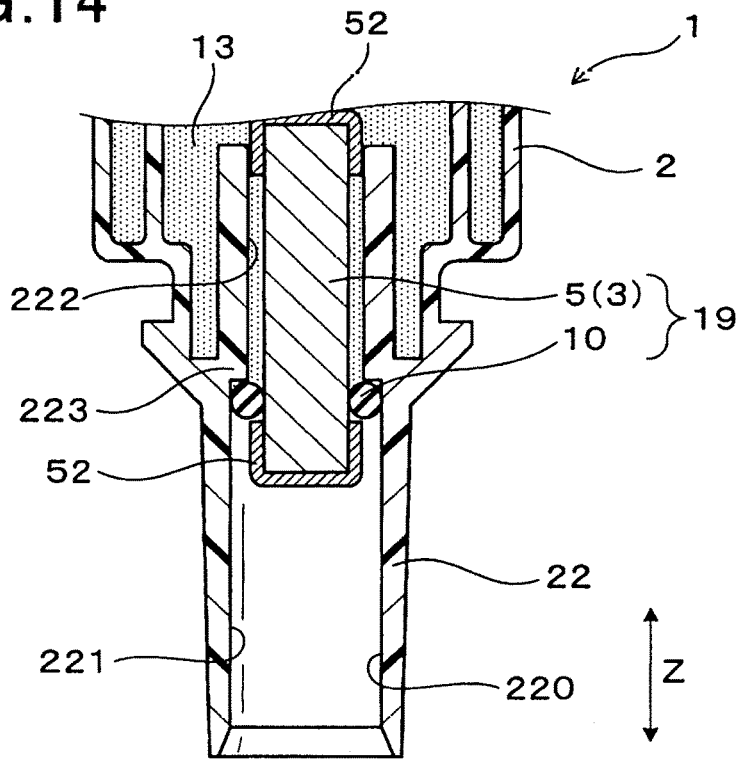
FIG. 14 is a sectional view which illustrates the region around a high-voltage tower of an ignition coil in the tenth embodiment.

The ignition coil 1 of this embodiment in FIG. 14, like in the ninth embodiment, has the plug 3 working as the resistor 5.

The high-voltage tower 22 has substantially the same structure as in the third embodiment. The elastic seal 10 is arranged between the outer peripheral surface of the resistor 5 and the inner peripheral surface of the high-voltage tower 22. The elastic seal 10 is of an annular shape and fit on the outer circumference of the resistor 5. Specifically, the elastic seal 10 is disposed between an outer periphery of a resistor body 51 of the resistor 5 and the inner periphery of the high-voltage tower 22. The elastic seal 10 is compressed in the radial direction thereof by the resistor 5 and the high-voltage tower 22, so that it is tightly attached or adhered to the resistor 5 (i.e., the resistor body 51) and the inner peripheral wall of the high-voltage tower 22 to hermetically seal a gap therebetween. The ignition coil 1 of this embodiment does not have the high-voltage output terminal 4, as shown in FIG. 1.

Next, an example of how to assemble the resistor 5 and the elastic seal 10 within the high-voltage tower 22.

First, the assembly 19 of the elastic seal 10 and the resistor 5 is prepared by inserting the resistor 5 into the elastic seal 10. Subsequently, the assembly 19 is inserted into the high-voltage tower 22 from outside the front end of the high-voltage tower 22. The elastic seal 10 of the assembly 19 is placed in abutment with the shoulder 223 of the high-voltage tower 22. The assembly 19 is then press-fitted into the rear hole portion 222 of the high-voltage tower 22 until the elastic seal 10 contacts the shoulder 223 in the axial direction Z. This achieves the alignment of the assembly 19 with the high-voltage tower 22 in the axial direction Z.

Other arrangements are identical with those in the first embodiment.

The structure of the ignition coil 1 of this embodiment facilitates the ease with which the assembly 19 of the elastic seal 10 and the resistor 5 is positioned relative to the high-voltage tower 22 in the axial direction Z. The resistor 5 works as the plug 3, thus resulting in a decreased number of parts of the ignition coil 1.

The ignition coil 1 of this embodiment also offers the same other advantages as in the first embodiment.

Eleventh Embodiment

Figure 15:
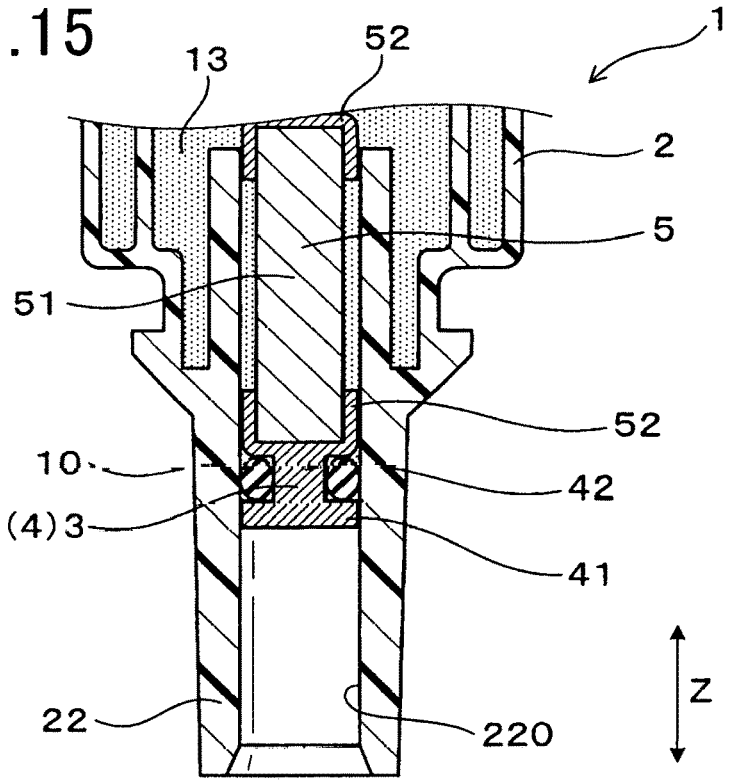
FIG. 15 is a sectional view which illustrates a high-voltage tower of an ignition coil in the eleventh embodiment which is a modification of the first embodiment.
Figure 16:
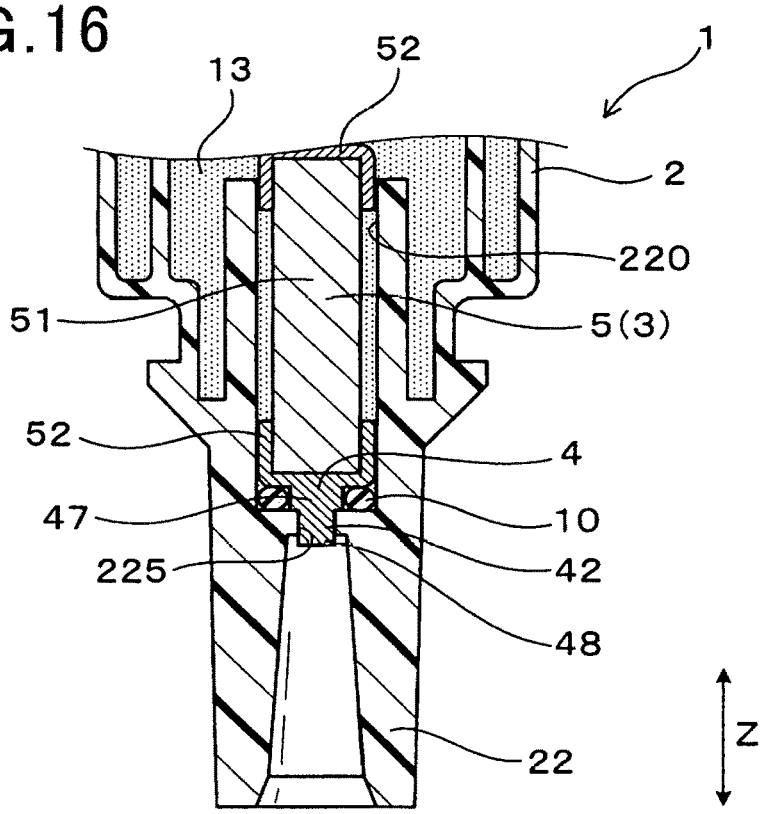
FIG. 16 is a sectional view which illustrates a high-voltage tower of an ignition coil in the eleventh embodiment which is a modification of the ninth embodiment.

The ignition coil 1 of this embodiment is engineered to have an integrally assembled unit of the electrode caps 52 of the resistor 5 and the high-voltage output terminal 4. FIG. 15 illustrates an example where the electrode caps 52 and the high-voltage output terminal 4 are integrally assembled in the ignition coil 1 of the first embodiment. FIG. 16 illustrates another example where the electrode caps 52 and the high-voltage output terminal 4 are integrally assembled in the ignition coil 1 of the ninth embodiment.

Other arrangements in FIGS. 15 and 16 are identical with those in the first embodiment, and explanation thereof in detail is omitted here.

The use of the integrally assembled unit of the electrode caps 52 of the resistor 5 and the high-voltage output terminal 4 ensures the stability in electrical conduction therebetween.

The structure of the ignition coil 1 of this embodiment also offers the same other advantages as in the first embodiment.

Twelfth Embodiment

Figure 17:
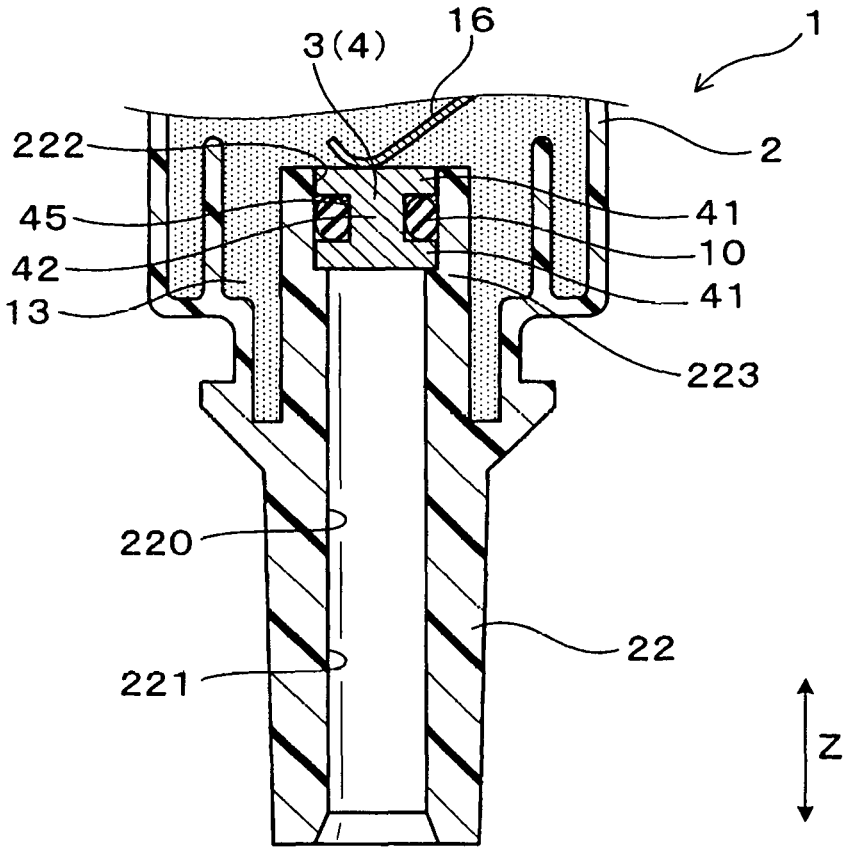
FIG. 17 is a sectional view which illustrates the region around a high-voltage tower of an ignition coil in the twelfth embodiment.

The ignition coil 1 of this embodiment is, as illustrated in FIG. 17, designed not to have a resistor.

The plug 3 is formed as the high-voltage output terminal 4. The high-voltage output terminal 4 has the base end surface placed in contact with the connector terminal 16 to electrically connect the high-voltage output terminal 4 to the secondary coil 12 through the connector terminal 16.

Other arrangements and beneficial advantages of the ignition coil 1 of this embodiment are identical with those in the sixth embodiment.

The ignition coil 1 of this embodiment in which the spark plug 65 is fit may be designed to have the resistor 5 installed within the high-voltage tower 22 to be closer to the front end of the ignition coil 1 than the front end of the high-voltage output terminal 4 is.

While the present invention has been disclosed in terms of the preferred embodiments in order to facilitate better understanding thereof, it should be appreciated that the invention can be embodied in various ways without departing from the principle of the invention.

For instance, the elastic seal 10 may be modified as long as it is tightly adhered to the plug 3 and the high-voltage tower 22 to hermetically seal a gap therebetween.

The elastic seal 10 in each of the embodiments is designed to be mechanically separate from the plug 3, but however, may alternatively be made by coating the outer circumferential surface of the plug 3 with an elastically deformable sealing material. The resistor 5 includes a ceramic resistor body, but may alternatively be made by a spiral or helical conductor. The ignition coil 1 may be made to have a structure that is one of all possible combinations of those in the above embodiments.

What is claimed is:

1. An ignition coil for an internal combustion engine comprising:

a primary coil and a secondary coil which are magnetically coupled together;

a case which includes a case body in which the primary coil and the secondary coil are disposed and a high-voltage tower which is of a cylindrical shape and extends from the case body;

a resinous filler which is packed in the case body to hermetically seal the primary coil and the secondary coil;

a plug which is disposed in the high-voltage tower to be electrically conductible in an axial direction of the ignition coil; and an elastic seal which is discrete from the high-voltage tower, of an annular shape, and attached to the plug and the high-voltage tower to hermetically seal a gap between the plug and the high-voltage tower.

2. An ignition coil as set forth in claim 1, wherein the plug is made of a metallic member.

3. An ignition coil as set forth in claim 2, wherein the high-voltage tower has disposed therein a resistor which works to reduce an electrical current noise, as arising from a spark plug joined to the ignition coil, the resistor being disposed closer to the case body than the plug is and hermetically sealed by the resinous filler.

4. An ignition coil as set forth in claim 1, wherein the plug works as a resistor which reduces electrical current noise, as arising from a spark plug connected to the ignition coil.

5. An ignition coil as set forth in claim 4, wherein the elastic seal is disposed between an outer peripheral surface of the resistor and an inner peripheral surface of the high-voltage tower.

6. An ignition coil as set forth in claim 3, wherein the plug has a groove formed therein or defined by itself and one of the high-voltage tower and the resistor, and wherein the elastic seal is disposed in the groove.

7. An ignition coil as set forth in claim 1, wherein an outer circumference of the annular shape of the elastic seal is in pressed contact against an inner circumference of the high-voltage tower.

8. An ignition coil as set forth in claim 1, wherein the plug includes a disc-shaped terminal portion and a cylindrical-shaped terminal portion which is smaller in diameter than the disc-shaped terminal portion and is located closer to the primary and secondary coils than the disc-shaped terminal portion.

* * * * *